United States Patent [19]

Cohen

[11] Patent Number: 4,967,062

[45] Date of Patent: Oct. 30, 1990

[54] GOLF BALL HEATING DEVICE

[75] Inventor: Wilburt Cohen, Yorktown Heights, N.Y.

[73] Assignee: Advanced Golf Concepts, Inc., Tarrytown, N.Y.

[21] Appl. No.: 447,977

[22] Filed: Dec. 8, 1989

[51] Int. Cl.[5] ..... H05B 3/34

[52] U.S. Cl. ..... 219/521; 219/386

[58] Field of Search ..... 219/385, 386, 387, 521, 219/214

[56] References Cited

U.S. PATENT DOCUMENTS

| | | | |
|---|---|---|---|
| 1,717,132 | 6/1929 | Weinmann | 219/521 |
| 1,829,093 | 10/1931 | Hollins | 150/1.5 C |
| 2,006,059 | 6/1935 | Rudorff | 219/521 |
| 2,664,933 | 1/1954 | Gielow | 150/1.5 C |
| 2,908,791 | 10/1959 | Torino | 219/214 |
| 2,950,748 | 8/1960 | Olinghous | 224/919 |
| 3,275,803 | 9/1966 | True | 219/535 |
| 3,497,676 | 2/1970 | Gravatt | 219/521 |
| 3,519,023 | 7/1970 | Burns, Sr. et al. | 219/535 X |
| 3,683,155 | 8/1972 | Loffbourow | 219/521 |
| 3,756,299 | 9/1973 | Simmons | 150/1.5 CX |
| 3,800,981 | 4/1974 | Zeller | 206/315 X |
| 3,828,165 | 8/1974 | Collins | 219/521 |
| 3,831,001 | 8/1974 | Toomey et al. | 219/386 |
| 4,082,209 | 4/1978 | Sanders | 224/29 B |
| 4,155,002 | 5/1979 | Cohen | 219/521 |
| 4,356,915 | 11/1982 | Phillips | 206/315 B |
| 4,420,681 | 12/1983 | Arnold | 219/521 |
| 4,545,362 | 10/1985 | Hendriks | 126/263 |
| 4,850,483 | 7/1989 | Stack | 206/315.9 |

FOREIGN PATENT DOCUMENTS

| | | | |
|---|---|---|---|
| 272001 | 6/1988 | European Pat. Off. . | |
| 638032 | 8/1983 | Switzerland | 219/521 |

*Primary Examiner*—Teresa J. Walberg

*Attorney, Agent, or Firm*—Pennie & Edmonds

[57] ABSTRACT

A golf ball heating device includes an elongated housing having a lower portion, an upper portion and a central opening therein for receiving a plurality of golf balls therein. The housing holds and retains the balls in a generally central axial position and facilitates flow of heated air around the balls. The housing further includes at least one aperture located in the upper portion for insertion or removal of the balls into or out of the central opening; a heating device located in the lower portion of the housing and extending along the interior sidewall at a predetermined spaced distance from the balls; a metal plate for supporting the air heating device and for reflecting heat towards the balls and into the housing interior; a spacer for retaining the air heating device at a predetermined distance below the balls, the spacer allowing heated air to flow toward the balls; and a lid member operatively associated with the housing aperture and movable between a first position, where the lid member closes the housing aperture, and a second position where access to the central opening through the aperture is provided to allow insertion or removal of the balls into or out of the central opening.

21 Claims, 3 Drawing Sheets

GOLF BALL HEATING DEVICE

CROSS REFERENCE TO RELATED APPLICATION

This application is a continuation-in-part of the applicant's application Ser. No.07/441,863, filed Nov. 27, 1989, entitled GOLF BALL HEATING DEVICE, the content of which is expressly incorporated herein by reference thereto.

TECHNICAL FIELD

This invention relates to a device for heating golf balls to increase the distance which the balls will travel when struck with a golf club.

BACKGROUND ART

It is known that a golf ball which is slowly and uniformly heated to a temperature of approximately 94 to 120° F. will demonstrate a maximum increase in distance when struck with a golf club compared to an unheated ball. Rapid heating of the balls in an uncontrolled manner, however, can cause the balls to explode, while heating to temperatures above approximately 125° F. will lead to deterioration of the golf ball. Conversely, a decline in the golf ball temperature from the optimum elevated temperature, such as may occur under playing conditions, decreases the extra distance which the golf ball will travel. It is therefore desirable to have a device which will not only safely heat the golf balls to the optimum temperature but which will also maintain them at or near that temperature under playing conditions.

Several prior art devices have been employed for the purpose of heating golf balls. In most cases, however, opening of the heated container to remove a selected ball simultaneously exposes all of the remaining balls to the ambient air, therefore making it difficult to maintain the remaining balls at the elevated temperature.

For example, U.S. Pat. Nos. 3,683,155 and 3,831,001 each essentially involve placement of the golf balls in a tray situated beneath a removable cover. When the cover is removed in order to select a ball, all of the remaining balls are simultaneously exposed to the ambient air. Similarly, U.S. Pat. No. 3,497,676 involves placement of the golf balls between two folding hinged elements, rather like an egg carton. Once again, opening the hinged elements exposes all balls simultaneously to ambient air.

U.S. Pat. No. 3,828,165 involves placing the golf balls in cylindrical tubes heated by the motive system of a golf cart. When the plug at the open end of the tube is removed in the course of extracting a selected ball, the remaining balls are exposed to the outside air. Although this reference does address the problem of maintaining the golf balls at the elevated temperature under playing conditions, the solution devised is continual heating by the motive system of the golf cart.

U.S. Pat. No. 4,420,681 discloses a hinged golf ball container for mounting over the speed control cart having a bottom opening through which heated air from the resistance elements can pass. A ball supporting baffle within the container protects the golf balls from radiant heat and causes circulation of the heated air around the balls for raising the temperature thereof. A dowardly depending deflector assists in directing heated air surrounding the resistance elements into the container.

Each of the devices of the two preceding patents is obviously dependent on the use of a golf cart and would therefore be unsuitable for the golfer who does not use such a cart or else desires a more portable apparatus.

U.S. Pat. No. 4,155,002 discloses a container for heating golf balls and maintaining them at an elevated temperature under playing conditions. This container is provided with dividing means, such as a moveable wall which is operated during removal of a selected heated ball so as to seal off the remaining heated balls from ambient air, thereby maintaining the balls at the elevated temperature.

None of these patents disclose a simple device which is capable of heating the balls to the desired temperature, maintaining the balls at such temperatures until they are to be played, and easily dispensing the heated balls when desired, whereby the container is easily transportable to the links.

SUMMARY OF THE INVENTION

The invention relates to a golf ball heating device comprising an elongated housing having a lower portion, an upper portion and an elongated interior space for holding and retaining a plurality of golf balls therein in a generally axial position. The housing facilitates the flow of heated air around the balls, and includes at least one aperture for insertion and removal of the balls into and out of the interior space. Means for heating air, located in the lower portion of the housing at a predetermined distance below the balls and extending along the interior sidewall of the housing beneath the air heating means, and a lid member operatively associated with the housing aperture are also provided.

A preferred shape for the housing is a generally elongated cylinder having a plurality of elongated rib members therein for positioning the balls and facilitating heated air flow therearound. In this embodiment, the lid member is rotatable between the first and second positions and may include means attached thereto to facilitate rotation thereof.

The device may further include a support member for the heating element, and the housing includes means for supporting the heating element support. This support element is preferably made of metal and extends along the interior sidewall of the housing beneath the air heating means. Preferably, the air heating means comprises a wire embedded in a non-conductive material, such as silicone, and a thermostatic control element may be included for controlling the temperature of the air heating means.

In addition, the housing may include means for reflecting heat from the heating element toward the balls in the housing. Preferably, the heat reflecting means may be the metal plate support for the air heating means, and the housing supporting means may include a plurality of lands on the housing interior for supporting the metal plate. A spacing member located between the balls and the heating means, may also be used to prevent direct contact therebetween. The spacing member preferably comprises at least one rod which is fixed in position with respect to the housing wall.

The air heating means is electrically connected to plug means located in the lower portion of the housing, and the device further comprises an electrical cord having means for connection to the plug means at one end of the cord and plug means at the other end of the cord for connection to an electrical outlet.

BRIEF DESCRIPTION OF THE DRAWINGS

Preferred embodiments of the invention are described hereinbelow with reference to the attached drawing figures, wherein.

DETAILED DESCRIPTION OF THE INVENTION

Figure 1:
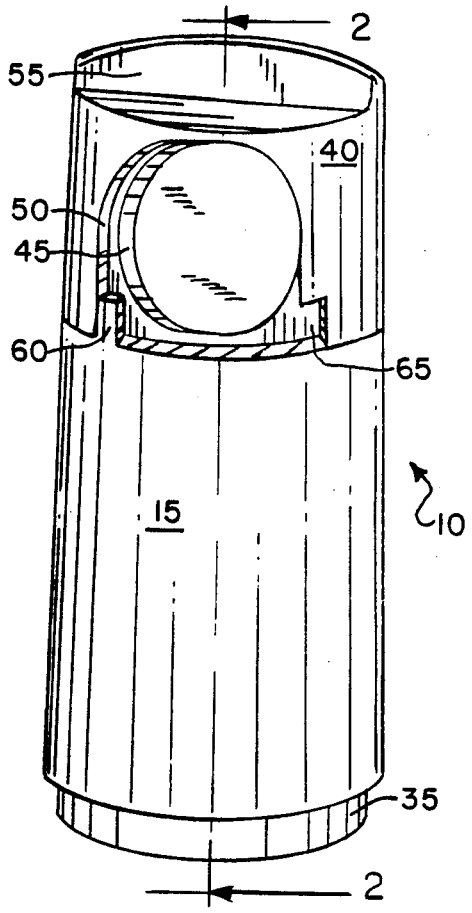
FIG. 1 is a perspective view of a golf ball heating device according to the present invention.

FIG. 1 illustrates a preferred golf ball heating device 10 according to the invention. A generally cylindrical hollow container is constructed of a sidewall 15 having an upper portion 20 and a lower portion 25. The container also includes a base portion 35 for supporting the unit and housing the electrical connections, and a lid member 40 for obtaining access therein to insert or remove golf balls.

The precise shape of the container is unimportant, and while the spherical shape of the balls makes a container having a circular cross-section the preferred embodiment, the container may also exhibit a triangular, square, rectangular, or elliptical cross-section which may increase or decrease in size (i.e., perimeter) along its length. In the preferred embodiment, a plurality of rib members 5 are utilized to position the golf balls in the center of the container. Since the size of the container shown in the FIGS. increases from top to bottom, the rib members 5 also increase in size so that they may be mounted upon the container sidewall. These rib members 5 provide space around the balls for flow of heated air. Although four rib members 5 are illustrated, a lesser or greater number can be utilized depending upon the selected shape of the container.

The material or materials used in construction of the container may be varied, although a heat insulating plastic is preferred since such materials will tend to conduct the electrically-generated heat towards the interior of the container, while insulating the interior from cooling effects due to the ambient air outside the container. The use of plastic as the material of the container further allows the device to be molded, with the rib members 5 being formed integral with the sidewalls. The other container components may be ultrasonically welded to form a sealed container.

The sidewall 15 contains an aperture 45 which is slightly greater than the diameter of a standard golf ball. FIG. 1 illustrates the lid member 40 of the invention in a rotated to a position where the aperture for is aligned with a corresponding aperture 50 in the lid member 40. In operation, the user grasps handle 55 and rotates the lid member 40 in a counterclockwise direction until a lower edge of the slot 50 abuts stop member 60. With the lid member 40 retained in that position, golf balls may be introduced into the container for heating thereof or heated golf balls may be removed from the container through apertures 45 and 50. After the container has been filled with golf balls for heating, lid member 40 is rotated in a clockwise direction until cutout portion 65 frictionally locks with stop member 60 to seal the unit from the entry ambient air thereinto. Since the lid member as well as the container is made of a heat insulating material, any heat generated by the heating means of the device will be retained therein for heating of the golf balls.

In operation, the invention functions as follows. The user initially opens the container by rotating the lid member to an open position as described above. Thereafter, three golf balls are placed into the hollow interior space of the container, and the lid member is rotated to a position where the aperture 45 is closed. An extension cord 90 having an electrical socket 85 at one end is connected to the container plug 80. The other end 95 of the cord 90 is connected to a power source. This provides electrical energy to the heating element 65 for generating heat to warm the golf balls. Under the controlled temperatures maintained by the thermostatic control element 75, the golf balls are allowed to slowly and uniformly warm to a temperature of approximately 94 to 120° F. over a period of about 12 to 24 hours. Upon attainment of the desired elevated temperature, the user disconnects the extension cord from the device and the power source and is able to take the heated container 10 to the golf course. Alternatively, the balls may be dispensed from the container into an insulated bag or pouch for transport to the course.

For purposes of removing the heated balls, the lid member 40 is opened, the container 10 is tilted, and the uppermost ball exits through the apertures 45, 50. To remove additional balls, the container is tilted far enough to allow the selected ball to be rolled into the upper portion 20 thereof adjacent the apertures 45, 50 while the lid member is in a closed position. At this point the lid member 40 may be rotated, thus permitting extraction of the selected ball while minimizing the entry of ambient air to contact the remaining heated golf ball, thereby maintaining it at the elevated temperature. The foregoing procedure can be repeated to extract the remaining heated ball.

The heating element 65 which is used in the present device comprises a wire which is arranged within a non-conductive material such as silicone. One preferred device is supplied by Ocean State Thermomics of Smithfield, R.I. and is designated as a silicone heater with an adhesive backing, model No. 3100-1623. This heating element 65 may be secured to a support plate 70 made of any material and which is located at a predetermined spaced distance below the balls to avoid direct contact of the balls with the heating element 65. A 1" strip of this heating element has been found to be useful. The length of the strip can vary depending upon the heating rate desired. For containers which will heat up to three balls, and wherein the user can wait for a time period of between 12 and 24 hours, a 1" length of heating element is sufficient.

For containers which are to heat a larger number of balls, or where more rapid heating to the desired temperature range of 94–120° F., a longer length of heating element 65 can be used. An advantageous length is one which extends from the support plate beneath the center of the lowest ball, to the container sidewall, and along the sidewall up to a point opposite the center of the uppermost ball. There is no further advantage in using longer lengths of heating element. Due to the adhesive backing of the heating element, it may be secured directly to the housing sidewall. As noted above, the rib members 5 retain the balls at a distance spaced from the interior wall and heating element, and also allow flow of heated air around the balls.

The adhesive backing also allows the heating element 65 to be securely mounted to a support plate 70 instead of directly mounted to the housing sidewall. A preferred support plate is made of a metal such as aluminum, since it will reflect the heat generated by the heating element 65 back into the container 10 for heating of the balls therein. A preferred shape for the support plate 70 is one which extends from the lower portion of the housing along the interior sidewall beneath the heating element. This allows maximum heat reflection for optimal heating of the balls.

Figure 2:
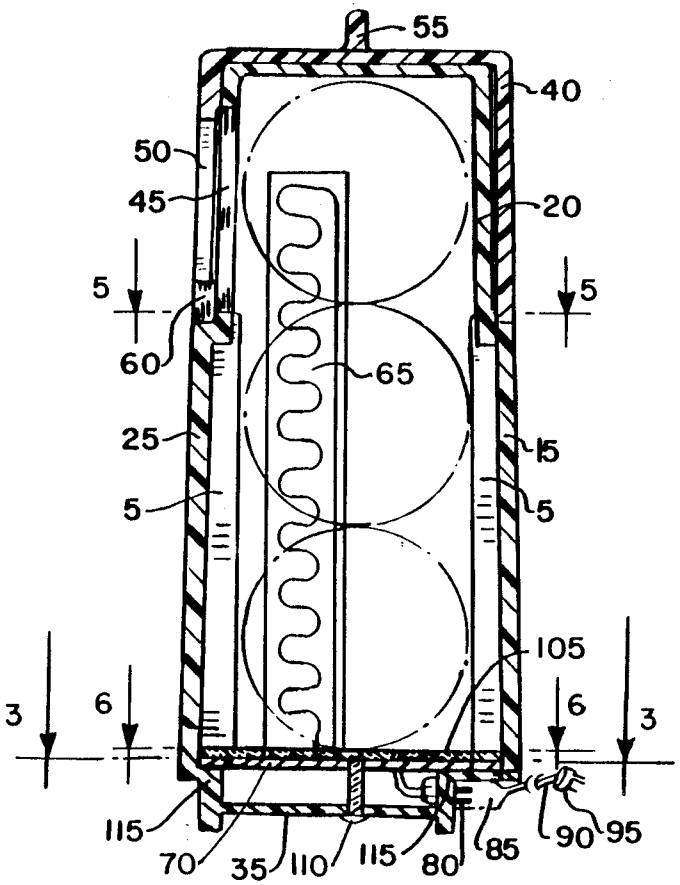
FIG. 2 is a cross-sectional view of the device of FIG. 1, taken along lines 2—2 thereof.
Figure 4:
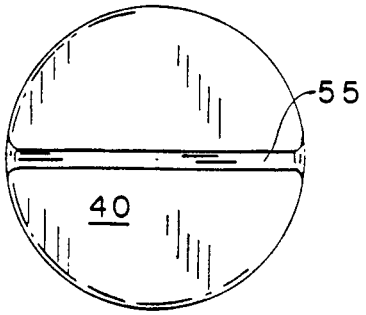
FIG. 4 is a top view of the device of FIG. 1.
Figure 5:
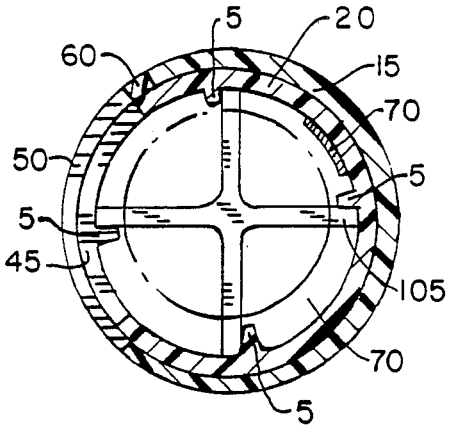
FIG. 5 is a cross-sectional view of the device of FIG. 1, taken along lines 5—5 thereof.

FIG. 2 illustrates the heating element 65 extending along the interior sidewall of the container. When a support plate is utilized, the heating element will be secured to the plate which is essentially the same width and length as the heating element 65. Larger widths and lengths for the support plate 70 can be used but are not necessary. Also, although the lowest portion of the support plate is shown as a disc, other shapes and sizes can be effectively used instead of the disc.

The heating element 65 is connected through a thermostatic control element 75 to the prongs 80 of the electrical outlet of the device. The wires interconnecting the heating element 65 and thermostatic control element 75 extend through the aluminum plate 70 and into the base portion 35 of the container for connection to the electrical prongs 80.

The prongs 80 are connected to household current through the use of an extension cord 90 having a plug 95 at one end for connection to a common household electrical outlet and a socket 85 on the opposite end of the cord for connection to the electrical prongs 80 of the device. The cord is preferably about 2 feet long. The prongs 80 are securely mounted in a wall member 100 so that the socket 85 of the cord may be easily connected or disconnected thereto. When the device is to be transported to the course while retaining the heated balls therein, the cord 90 can be disconnected to facilitate storage and transport thereof. Also, if desired, the heated balls can be removed from the device and placed into an insulated bag so that they can be more easily transported to the links in the pocket of the clothing of the user. The insulated bag helps retain the balls at the elevated temperature.

Figure 3:
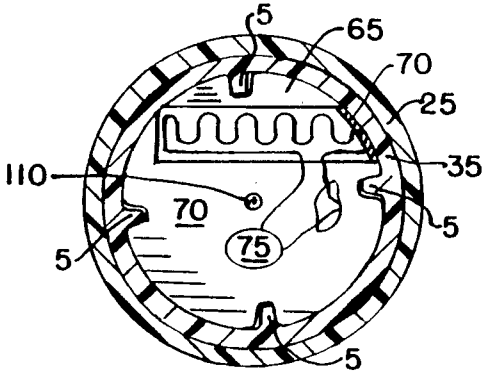
FIG. 3 is a cross-sectional view of the device of FIG. 1, taken along lines 3—3 thereof.

Another useful heating element is made of a resistance wire which is mounted on a support in place of heating element 65, plate 70 and thermostatic control element 75 of the device of FIG. 3. This resistance wire has an internal resistance that allows heating only to a particular predetermined temperature, in this case a maximum of about 120° F. This avoids the use of the thermostat and simplifies the construction of device. The resistance wire can extend along the interior sidewall of the housing. As noted above, and can be used with or without the heat reflecting metal support plate.

Figure 6:
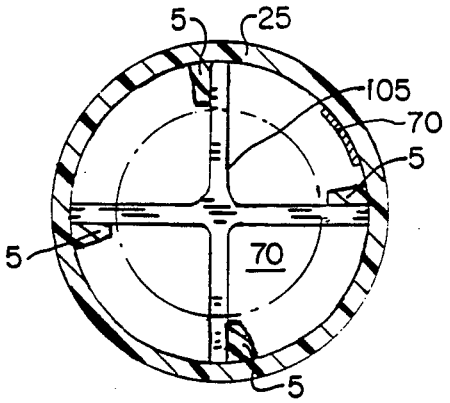
FIG. 6 is a cross-sectional view of the device of FIG. 1, taken along 6—6 thereof.

As mentioned above, the heating element is separated from the balls by the rib members 5 of the container and by the use of a spacer element 105 shown in FIG. 6 as a cross of a plastic or other heat insulating material. The cross 105 and heating element support plate 70 are retained in position in a device by screw 110 which engages and downwardly forces the cross 105 and plate 70 against a plurality of lands 115 located on the interior lower portion of the housing. Thus, the heating element is securely retained in the bottom of the housing for safety purposes.

It will be apparent to those skilled in the art that various changes may be made in the size, shape, number, type, and arrangement of parts described herein without departing from the true spirit and scope of this invention.

I claim:

1. A golf ball heating device comprising an elongated housing having a lower portion, an upper portion and an interior space for retaining a plurality of golf balls therein in a generally axial position, said housing also facilitating the flow of heated air around the balls, and including at least one aperture positioned on a side of the housing in the upper portion thereof for insertion and removal of the balls into and out of said interior space;

means for heating air located in said housing at a predetermined spaced distance from the balls; and a lid member operatively associated with said housing aperture and movable between a first position, where said lid member closes said housing aperture, and a second position where access to said interior space through said aperture is provided to allow insertion or removal of the balls into or out of said interior space.

2. The device of claim 1 further comprising a support member of said air heating means, and wherein said housing further comprises means for supporting said support element, said support element also extending along the interior sidewall of the housing beneath said air heating means.

3. The device of claim 1 wherein said air heating means comprises a wire embedded in a non-conductive material.

4. The device of claim 1 further comprising a thermostatic control element for controlling the temperature of the air heating means.

5. The device of claim 1 wherein said housing is generally cylindrical and includes a plurality of elongated rib members therein for positioning the balls and facilitating heated air flow therearound.

6. The device of claim 1 wherein said lid member is rotatable between said first and second position and further comprising means attached to said lid member to facilitate rotation thereof.

7. The device of claim 1 further comprising means for reflecting heat from said air heating means toward the balls in said housing, said heat reflecting means located beneath said air heating means.

8. The device of claim 1 further comprising a spacing member located between the balls and said air heating means.

9. The device of claim 1 wherein said air heating means is electrically connected to plug means located in the lower portion of said housing.

10. The device of claim 9 further comprising an electrical cord having means for connecting to said plug means at one end of said cord and plug means at the other end of said cord for connection to an electrical outlet.

11. A golf ball heating device comprising:

an elongated housing having a lower portion, an upper portion and an elongated interior space for receiving a plurality of golf balls therein, said housing including means for retaining the balls in a generally axial position and for facilitating flow of heated air around the balls, said housing further including at least one aperture located in said upper portion for insertion and removal of said balls into and out of said interior space;

means for heating air located in said housing and extending along an interior sidewall of the housing at a predetermined spaced distance from the balls, said housing further comprising a plastic member for supporting the balls;

means for spacing said air heating means at a predetermined distance below the balls, said spacing means allowing heating air to flow toward the balls; and a lid member operatively associated with said housing aperture and movable between a first position, where said lid member closes said housing aperture, and a second position where access to said interior space through said aperture is provided to allow insertion or removal of said balls into or out of said interior space;

wherein said air heating means is mounted on a metal plate to reflect said heated air toward the balls, and wherein said housing includes a plurality of lands on an interior wall for supporting said plastic member.

12. A golf ball heating device comprising:

an elongated housing having a lower portion, an upper portion and an elongated interior space for receiving a plurality of golf balls therein, said housing including means for retaining the balls in a generally axial position and for facilitating flow of heated air around the balls, said housing further including at least one aperture positioned on a side of the housing and located in said upper portion for insertion and removal of said balls into and out of said interior space;

means for heating air located in said housing at a predetermined spaced distance from the balls, said housing further comprising means for supporting said air heating means;

means for spacing said air heating means at a predetermined distance below the balls, said spacing means allowing heating air to flow toward the balls; and a lid member operatively associated with said housing aperture and movable between a first position, where said lid member closes said housing aperture, and a second position where access to said interior space through said aperture is provided to allow insertion or removal of said balls into or out of said interior space.

13. The device of claim 12 wherein said housing is generally cylindrical and said ball retaining means comprises a plurality of elongated rib members located on an interior wall of said housing, the space between the rib members facilitating the flow of heated air around the balls.

14. The device of claim 12 wherein said air heating means includes means for controlling the temperature generated thereby.

15. The device of claim 12 wherein said air heating means comprises a wire embedded in a non-conductive material and a thermostatic control element for controlling the temperature generated thereby.

16. The device of claim 12 wherein said spacing means comprises at least one rod which is fixed in position with respect to said housing wall.

17. The device of claim 12 further comprising means for reflecting heat from said air heating means, toward the balls in said housing, said heat reflecting means located beneath said air heating means.

18. The device of claim 12 wherein said ball retaining means comprises a plurality of elongated rib members located on an interior wall of said housing, the space between the rib members facilitating the flow of heated air around the balls and further wherein said support means comprises a metal plate to reflect said heated air toward the balls, said plate also extending along said interior sidewall beneath said air heating means.

19. A golf ball heating device comprising:

a generally elongated housing having a lower portion, an upper portion and an elongated interior space for receiving a plurality of golf balls therein, said housing including means for retaining the balls in a generally axial position and for facilitating flow of heated air around the balls, said housing further including at least one aperture located in said upper portion for insertion or removal of said balls into or out of said interior space;

means for heating air located in said housing and extending along an interior sidewall of the housing at a predetermined spaced distance from the balls;

means for supporting said air heating means located beneath said air heating means and capable of reflecting heat from said air heating means toward the balls;

means for spacing said air heating means at a predetermined distance from the balls for allowing heated air to flow toward the balls; and a generally cylindrical lid member operatively associated with said housing aperture and rotatable between a first position, where said lid member closes said housing aperture, and a second position where access to said interior space through said aperture is provided to allow insertion and removal of said balls into and out of said interior space, said lid member including means to facilitate rotation thereof.

20. The device of claim 19 where said at least one aperture is located in a side wall of said housing.

21. A golf ball heating device comprising an elongated housing having a lower portion, an upper portion and an interior space for retaining a plurality of golf balls therein in a generally axial position, said housing also facilitating the flow of heated air around the balls, and including at least one aperture for insertion and removal of the balls into and out of said interior space;

a heating element for heating air located in said housing and extending along an interior sidewall of the housing at a predetermined spaced distance from the balls; and a lid member operatively associated with said housing aperture and movable between a first position, where said lid member closes said housing aperture, and a second position where access to said interior space through said aperture is provided to allow insertion or removal of the balls into or out of said interior space.

* * * * *